United States Patent [19]

Densen

[11] 4,365,738

[45] Dec. 28, 1982

[54] KNOCK DOWN CONTAINER PACKAGE AND METHOD OF MAKING SAME

[76] Inventor: Mark Densen, 18 Blackburn Pl., Summit, N.J. 07901

[21] Appl. No.: 186,906

[22] Filed: Sep. 15, 1980

[51] Int. Cl.[3] ..... B65D 5/32; B65D 65/16

[52] U.S. Cl. ..... 229/23 R; 53/411; 53/429; 53/435; 53/447; 53/461; 206/45.33; 206/459; 206/494; 229/41 R; 493/53

[58] Field of Search ..... 206/459, 45.33, 497, 206/449, 494; 53/429, 435, 411, 447, 461; 229/87 R, 52 B, 43, 23 R, 23 BT, 41 R; 493/53, 187, 320

[56] References Cited

U.S. PATENT DOCUMENTS

| | | | |
|---|---|---|---|
| 1,142,084 | 6/1915 | Fenlason | 229/23 R |
| 1,942,673 | 1/1934 | Weiner | 206/494 |
| 2,401,944 | 6/1946 | Levkoff | 206/45.33 |
| 2,791,366 | 5/1957 | Geisler | 229/52 B |
| 2,915,208 | 12/1959 | Benschoter | 206/494 |
| 3,058,643 | 10/1962 | Wilson | 229/23 R |
| 3,291,364 | 12/1966 | Fischer | 229/23 R |
| 3,744,700 | 7/1973 | Stegmann | 229/23 R |
| 3,837,561 | 9/1974 | Rubin | 229/23 BT |
| 3,987,897 | 10/1976 | Smith | 206/497 |
| 4,264,009 | 4/1981 | Tattam | 206/449 |

*Primary Examiner*—William Price
*Assistant Examiner*—Gary E. Elkins
*Attorney, Agent, or Firm*—Arthur T. Fattibene

[57] ABSTRACT

A knock down container package and method of making it which comprises several banks of sheet material which are each die cut and scored in a predetermined manner so that each blank can be readily folded to define a component part of the container in the assembled position wherein one of the blanks has formed on the inner surface thereof suitable indicia. The respective blanks in their knock down position are folded and/or stacked one on the other with the inner surface of the blank having the indicia thereon disposes inner surface up on the top of the stack, and the stack then encapsulated in a see-through wrapping.

3 Claims, 6 Drawing Figures

KNOCK DOWN CONTAINER PACKAGE AND METHOD OF MAKING SAME

PROBLEM AND PRIOR ART

Heretofore in the packaging of knock down containers formed of sheet material considerable difficulty and/or expense has been incurred. The packaging of such knock down containers has been further complicated in that the component parts have varying dimensions and for this reason have presented some problems in forming a resulting package which can be readily shipped or stored so as to occupy a minimum of space. Also, it is imperative with such articles that an instruction sheet and/or other informative material be included in the package so as to function as an aid or guide to the ultimate consumer for the assembly of the container. Generally, such instructions or other information was separately formed and constituted another item which was either separately distributed or included in the package in a manner where such information was not readily accessible to the ultimate user until the package was purchased or opened. The additional requirement of making and packaging such material in a knock down container package was relatively costly and required additional labor and/or manual manipulations, all of which tended to increase the cost of the ultimate article to the consumer.

OBJECTS

An object of this invention is to provide a knock down container package and a method of making it with a minimum of cost and labor.

Another object is to provide a knock down container package and method of making it in which the identifying and/or informative indicia is formed as an integral part of the container and its package.

Another object of this invention resides in the provision of a knock down container package in which the informative indicia constitutes an integral part of the package and which is readily visible to the ultimate consumer.

Another object of the invention is to provide a knock down container package in which the informative indicia cannot be readily separated from the container either in its knock-down packaged position or its assembled operative position.

SUMMARY OF THE INVENTION

The foregoing objects and other features and advantages of this invention are attained by a knock down container package which comprises a plurality of blanks of sheet material, each blank being pre-cut and scored whereby the respective blanks can be folded and maintained to form a container body and closure therefor. The blank defining the container body is provided with a pair of spaced apart foldlines whereby the blank can be readily folded onto itself in the knock down position to define a size which is equal to substantially the size of the blank forming the closure or cover for the container. Informative indicia is deposed on the inside surface of one of the blanks and the respective blanks are superposed one on the other with the blank having the informative indicia disposed inside up on top of the superposed stacked blanks. The entire stack of superposed blanks is then enwrapped with a transparent covering wrap where the indicia and the respective knock down components are rendered readily visable to the ultimate consumer. The informative indicia formed as an integral part of one of the blanks cannot then be readily separated therefrom, and as an integral part thereof minimizes the cost and labor involved in making the package.

FEATURES

A feature of this invention resides in the provision of a knock down container package in which the informative indicia is formed as an integral part of one of the blank components.

Another feature resides in the provision wherein the informative indicia is located on the inner surface of a blank sheet material.

Another feature resides in the provision wherein the knock down blank defining the container body is prefolded to define a knock down blank which is equal in size to the other blank of said package.

Other features and advantages will become more readily apparent when considered in view of the drawings and specifications in which.

DETAILED DESCRIPTION

Figure 1:
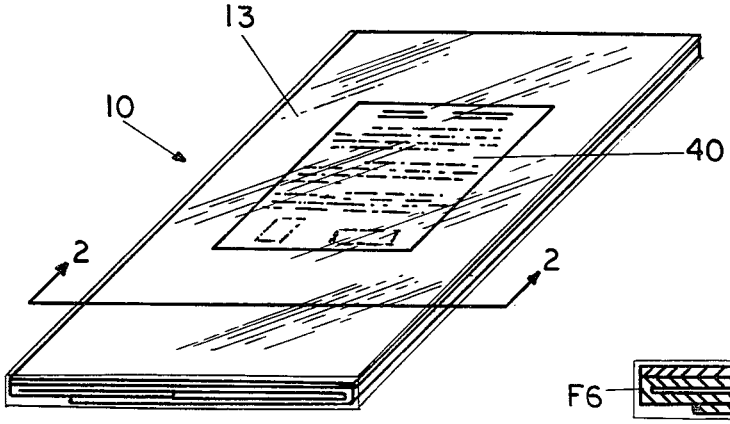
FIG. 1 is a plan perspective view of a knock down container package embodying the invention.
Figure 2:
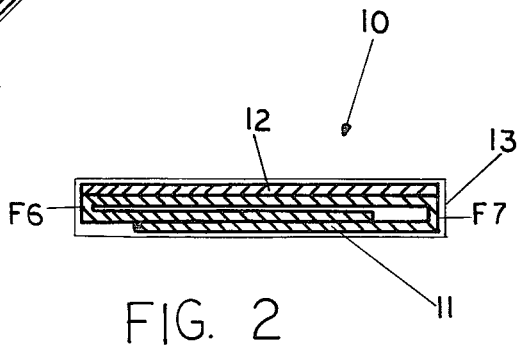
FIG. 2 is a section view taken along line 2—2 on FIG. 1.

Referring to the drawings there is shown in FIGS. 1 and 2 a knock down container package 10 embodying the invention. In the illustrated embodiment the container package 10 comprises a plurality of blanks 11 and 12 of sheet material which are disposed in superposed position whereby the largest of the blanks 11 is folded in a knock down position in a manner to equal the size and shape of the smallest blank 12 so as to define a minimum overall package size. In the illustrated embodiment the package 10 is made of two blanks of sheet material 11 and 12 and a covering wrap of a transparent, see-through, plastic wrapping 13.

Figure 3:
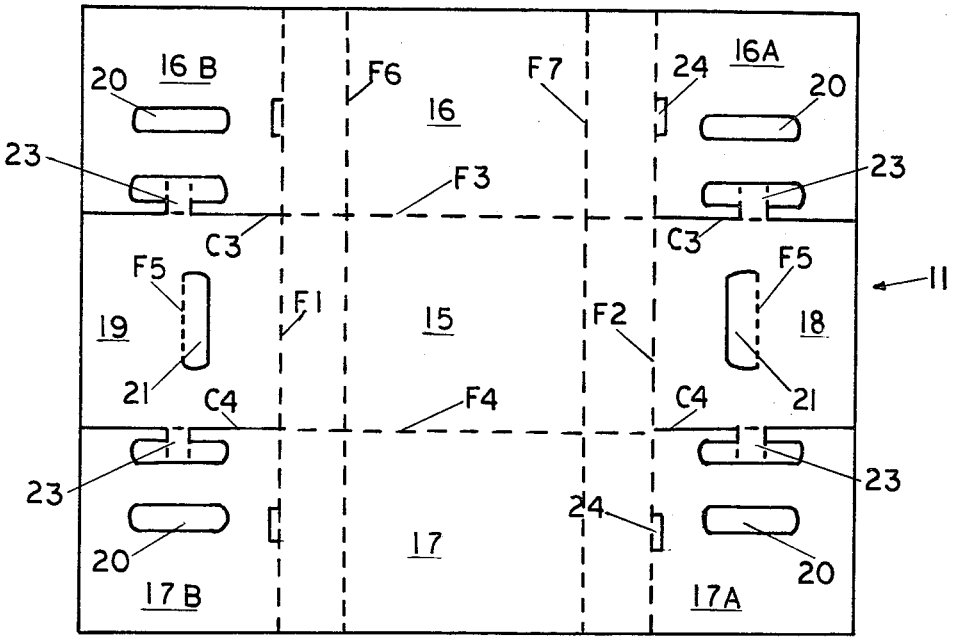
FIG. 3 is a plan view of a blank of sheet material for forming the container body.
Figure 4:
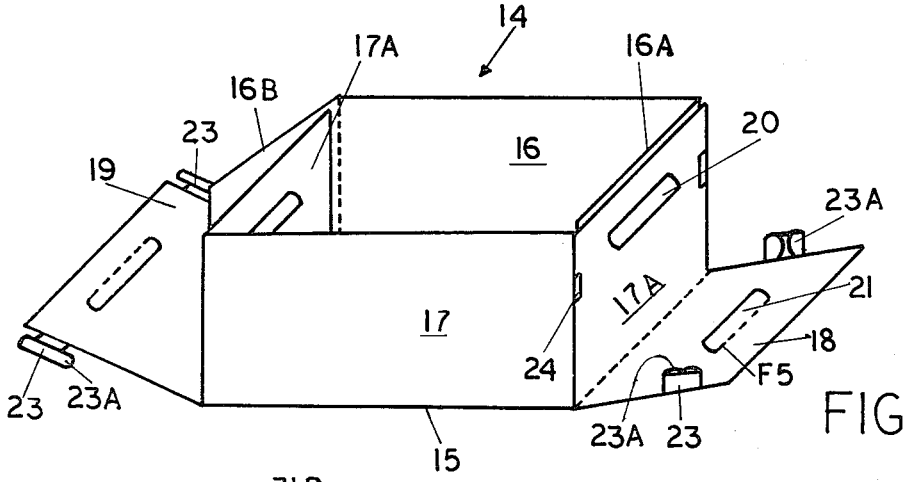
FIG. 4 is a perspective view of the container body blank in a partially set up position.

Referring to FIGS. 3 and 4, blank 11 comprises a flat sheet of material which is provided with a plurality of foldlines and scored or die cuts about which the blank can be readily folded as shown in FIG. 4 to define a container body 14 having a full open top. The blank 11 is provided with a pair of spaced apart transverse foldlines F1 and F2 and a pair of longitudinal foldlines F3 and F4, which intersect to define a bottom wall portion 15 and connected opposed side wall portions 16 and 17. The respective side wall portions has connected to each side end thereof a side end flap 16A, 16B and 17A, 17B respectively. The end extensions of foldlines F3 and F4 are die cut at C3 and C4 to define end walls 18 and 19. The respective side end flaps 16A, 16B and 17A, 17B are each provided with a handle cut-out opening 20 which in the folded position of the blank 11 are disposed in alignment as shown in FIG. 4. The respective end walls 18 and 19 are formed with a die cut handle flap 21 which is foldable about a foldline F5. In the set up position of the container body as shown in FIG. 4, the handle flap 21 is folded to project inwardly of the aligned openings 20 so as to function as a lock to maintain the folded side end flaps and end wall in the assembled position. The respective end walls have connected thereto locking tabs 23 which are blanked out of the adjacent side end flaps 16A, 16B and 17A, 17B respectively. The ends 23A of the lock tab 23 are reversely folded, as seen in FIG. 4, and in the set up position are inserted into end slots 24 formed adjacent to the foldlines about which side end flaps 16A, 16B and 17A, 17B are hinged to lock the end wall to the side walls.

Referring to FIG. 3, the blank 11 is further provided with a second pair of transversely extending foldlines F6 and F7 which are spaced so that the blank 11 in its folded knock down position, as shown in FIG. 2, can be folded onto itself to reduce its overall size for packaging. In the illustrated embodyment the foldlines F6 and F7 are disposed to fold the blank 11 to a size equal to the size of the cover blank 12 shown in FIG. 5.

Figure 5:
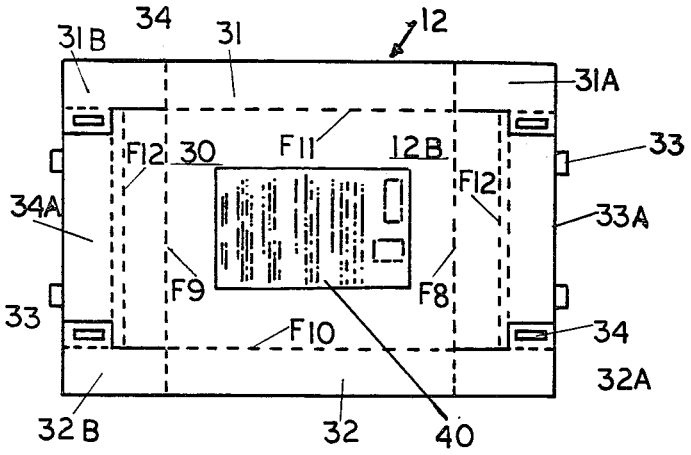
FIG. 5 is a plan view of the closure blank.
Figure 6:
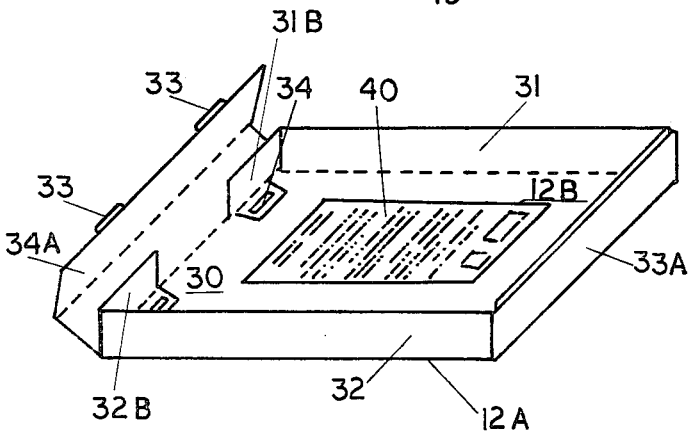
FIG. 6 is a perspective view of the closure blank in a partially assembled position.

Referring to FIGS. 5 and 6, the blank 12 is provided with an outer surface 12A and an inner surface or side 12B. The cover blank 12 is also provided with a pair of intersecting foldlines F8, F9 and F10, F11, to divide the blank into a top panel 30 and connected top side panels 31 and 32. Connected to the respective top side panels to hinge about the extended ends of foldlines F8 and F12 are end flaps 31A, 31B and 32 A, 32B, respectively. The respect end flaps are die cut to separate the respective end flaps 31A, 31B and 32A, 32B from the end panels $33^A$ and $34^A$. As best seen in FIGS. 5 and 6, the respective end panels is provided with an intermediate foldline F12 about which the respective end panels can be reversely folded in the assembled position of the top. The outer most edge of the end panels 33A and 34A are provided with projecting tabs 33 which are adapted to be received in slots 34 formed in the end flaps 31A, 31B and 32A, 32B, respectively.

In accordance with this invention the informative indicia means 40 is located on the inner surface 12B of blank 12. The indicia means may comprise any suitable information such as the instruction and diagrams necessary for setting up the container or any other useful information desired. This indicia may be formed onto the blank by any suitable means such as a roller printing or other means during the forming of the blank. Thus, the informative indicia becomes an integral part of the blank and is rendered inseparable therefrom in either the knock down or assembled position.

To form the package as shown in FIGS. 1 and 2 the respective blanks 11 and 12 are blanked and scored with the predetermined foldlines and die cuts or scores as herein defined. The container body blank because of its relatively larger size is folded about fold lines F6 and F7 as shown in FIG. 2 to reduce its overall size to that of the cover blank 12. With the container body 11 folded, the cover blank 12 is superimposed onto the folded blank 11 with the inner surface facing up as shown in FIG. 1, so that the indicia means 40 defines the top of the stacked blanks. With the blanks 11 and 12 so stacked, the blanks are then wrapped or encased in a clear plastic wrap 13. With the package described, the informative indicia 40 which is formed as an integral part of the blank is readily visible to the consumer and is always available to the consumer. The construction of the package as described is such that the informative material is included in the package and becomes an integral part thereof with a minimum of cost and labor.

While the invention has been described with respect to a particular embodiment, it will be understood that variations and modifications may be made without departing from the spirit and scope of the invention.

I claim:

1. A knock down container package comprising a plurality of blanks of sheet material, each of said blanks having predetermined foldlines about which the respective blanks can be readily folded to define a component part of a body and cover of container in the assembled position of said respective blanks, each of said blanks having an outer surface and an inner surface, indicia means disposed on the inner surface of at least one of said blanks, said blanks being disposed in their respective knock-down position in superposed relationship whereby the inner surface of said blank having said indicia means is disposed inner side up on the other of said blank, and wrapping means having a see through portion enwrapping said superposed blanks whereby said see-through portion overlies said indicia means, and one of said blanks having a pair of foldlines to effect the folding of said one blank in the knock-down position so that the superposed blanks in the superposed knock-down position are substantially equal in width and length in the knock down package position.

2. A knock down container package comprising a plurality of blanks including a blank of sheet material having a plurality of predetermined foldlines and complementary scored lines along which said blank can be readily folded to define a rectangular full open top container body in the assembled position of said blank, a second blank of sheet material, said second blank of sheet material having a series of predetermined foldlines and complementary score lines arranged to define a closure for said assembled container in the assembled position of said second blank, each of said blanks having an outer surface and an inner surface, and indicia means located on the inner surface of at least one of said blanks, said blanks being adapted to be disposed in superposed flat position one on the other whereby the inner surface of the said blank having said indicia means is disposed inner side up on said other blank, and a clear plastic wrap encapsulating said superposed knockdown blanks to define a flat plackage wherein said indicia means is clearly visible through said plastic wrap, wherein said first mentioned blank in addition to said plurality of body forming foldlines includes a second pair of transversely extending non body forming foldlines disposed in spaced relationship intermediate to the length of said first blank whereby said second pair of foldlines enable said first blank to be folded upon itself in the knock down position, the spacing between said second pair of foldines being substantially equal to the width of said second blank in the knockdown position so that said blanks in the superposed position thereof are of general uniform shape.

3. A method of packaging a knock down container which includes a container body and a closure therefor, each of which is adapted to be assembled from a sheet of blank material comprising the steps of precutting and scoring a blank of sheet material of predetermined width and length so that said blank can be readily folded to define a container body in the assembled position thereof; scoring said blank with a pair of transversing spaced apart foldlines whereby said blank can be readily folded upon itself in the knock down position; pre-cutting and scoring a second blank of sheet material so that said second blank can be readily folded to define a cover for said container body in the assembled position thereof, forming indicia on the inner surface of said second blank, stacking said second blank inner surface up onto said first mentioned folded blank, whereby said blank forming said container body being folded onto itself along said pair of transversely spaced foldlines in the knock-down position so as to conform in shape to the shape of the knock-down second blank, and enwrapping said stacked blanks with a transparent wrapping material so that said indicia means is visible through said transparent wrapping material.

* * * * *